US011200863B2

(12) United States Patent
Wang

(10) Patent No.: US 11,200,863 B2
(45) Date of Patent: Dec. 14, 2021

(54) DRIVING METHOD OF DISPLAY PANEL, DRIVING DEVICE AND DISPLAY DEVICE

(71) Applicants: HKC Corporation Limited, Shenzhen (CN); Chongqing HKC Optoelectronics Technology Co., Ltd., Chongqing (CN)

(72) Inventor: Mingliang Wang, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 231 days.

(21) Appl. No.: 15/740,799

(22) PCT Filed: Oct. 18, 2017

(86) PCT No.: PCT/CN2017/106755
§ 371 (c)(1),
(2) Date: Dec. 17, 2019

(87) PCT Pub. No.: WO2018/233157
PCT Pub. Date: Dec. 27, 2018

(65) Prior Publication Data

US 2020/0111437 A1 Apr. 9, 2020

(30) Foreign Application Priority Data

Jun. 20, 2017 (CN) ..... 201710471820.2

(51) Int. Cl.
*G09G 3/36* (2006.01)

(52) U.S. Cl.
CPC ..... *G09G 3/3688* (2013.01); *G09G 3/3696* (2013.01); *G09G 2330/021* (2013.01)

(58) Field of Classification Search
None
See application file for complete search history.

(56) References Cited

U.S. PATENT DOCUMENTS

2004/0136440 A1* 7/2004 Miyata ..... H03L 7/0895 375/130

FOREIGN PATENT DOCUMENTS

CN 106356021 B * 2/2020 ..... G09G 3/32

* cited by examiner

*Primary Examiner* — Krishna P Neupane
(74) *Attorney, Agent, or Firm* — Wang Law Firm, Inc.

(57) ABSTRACT

A driving method of a display panel includes the steps of: using a timing controller chip to receive a first data signal of a control board; using the timing controller chip to convert the first data signal into a second data signal; using the timing controller chip to generate a variable-frequency first clock signal, and to transmit the second data signal and the first clock signal to a source driving chip; and using the timing controller chip to obtain the first clock signal and generate a second clock signal by frequency multiplication, the second clock signal being a preset multiple of that of the first clock signal; wherein the second clock signal serves as an internal clock signal of a power supply chip circuit, and the second clock signal is inputted to the power supply chip circuit.

14 Claims, 9 Drawing Sheets

DRIVING METHOD OF DISPLAY PANEL, DRIVING DEVICE AND DISPLAY DEVICE

CROSS-REFERENCES TO RELATED PATENT APPLICATION

This application claims priority to and the benefit of Chinese Patent Application No. 201710471820.2, filed on Jun. 20, 2017, entitled "driving method of display panel, driving device and display device", and the disclosure of which is incorporated herein in its entirety by reference.

FIELD OF THE INVENTION

The present invention relates to the display technology, and more particularly to a driving method of a display panel, a driving device and a display device.

BACKGROUND OF THE INVENTION

A thin film transistor liquid crystal display (TFT-LCD) is one of panel displays on the market, and it has become an important display platform of modern IT and video products. The driving principle of the TFT-LCD is that a system board connects an R/G/B compression signal, a control signal and a power supply with a connector of a printed circuit board (PCB) through the electrical wiring. After the data is processed by a timing controller chip of the printed circuit board, the data is transmitted to a display area through a source-chip on film (S-COF) and a gate-chip on film (G-COF), so that the LCD obtains the required power supply and signals.

These days, LCD TVs become larger in size, and the current trend is towards high-resolution. With the increase in TV power consumption, the problem of electromagnetic interference (EMI) becomes increasingly serious. The most serious EMI comes from the radiation of the power supply. Because the products must meet the national verification standards before shipment, manufactures pay more and more attention to weaken the electromagnetic interference of the power supply end.

The commonly used method is that the output end of the power supply is provided with an electromagnetic interference suppression component or a buffer circuit using RC (resistance and capacitance in series). However, the electromagnetic interference suppression component can only weaken a part of the conduction interference, and it is unable to overcome the radiation interference. The RC buffer circuit can play a certain effect for a low-power circuit, but it is ineffective for a high-power circuit.

SUMMARY OF THE INVENTION

In view of the shortcomings of the prior art, the primary object of the present invention is to provide a driving method of a display panel, a driving device and a display device which are capable of reducing the electromagnetic interference of a power supply circuit.

According to one aspect of the present invention, a driving method of a display panel is provided. The method comprises the steps of: using a timing controller chip to receive a first data signal of a control board; using the timing controller chip to convert the first data signal into a second data signal; using the timing controller chip to generate a variable-frequency first clock signal, and to transmit the second data signal and the first clock signal to a source driving chip; and using the timing controller chip to obtain the first clock signal and generate a second clock signal by frequency multiplication, a frequency of the second clock signal being a preset multiple of that of the first clock signal. Wherein, the second clock signal serves as an internal clock signal of a power supply chip circuit, and the second clock signal is inputted to the power supply chip circuit.

According to another aspect of the present invention, a driving device is provided. The driving device comprises a timing controller chip and a power supply chip circuit. The timing controller chip is configured to receive a first data signal of a control board and convert the first data signal into a second data signal of a driving data line. The timing controller chip is further configured to generate a variable-frequency first clock signal, and to transmit the second data signal and the first clock signal to a source driving chip. The timing controller chip is further configured to obtain the first clock signal and generate a second clock signal by frequency multiplication. The second clock signal is a preset multiple of the first clock signal. The power supply chip circuit is configured to receive the second clock signal and driving an internal circuit of the power supply chip circuit according to the second clock signal.

According to a further aspect of the present invention, a display device is provided. The display device comprises a display panel and the aforesaid driving device.

According to a yet further aspect of the present invention, a driving method of a display panel is provided. The method comprises the steps of: using a timing controller chip to receive a first data signal of a control board; using the timing controller chip to convert the first data signal into a second data signal; using the timing controller chip to generate a variable-frequency first clock signal, and to transmit the second data signal and the first clock signal to a source driving chip; using a phase-locked loop module of the timing controller chip to obtain the first clock signal and generate a second clock signal by frequency multiplication, a frequency of the second clock signal being a preset multiple of a frequency of the first clock signal; dividing the second clock signal by the preset multiple by frequency demultiplication to generate a comparison clock signal; comparing the first clock signal with the comparison clock signal to obtain a frequency difference value; generating an adjustment voltage according to the frequency difference value; and generating the second clock signal that is the preset multiple of the first clock signal according to the adjustment voltage; wherein the second clock signal serves as an internal clock signal of a power supply chip circuit, and the second clock signal is inputted to the power supply chip circuit.

In the driving method of the display panel, the driving device and the display device, The timing controller chip receives a first data signal transmitted by a front end system control board, and converts the first data signal into a second data signal of a driving data line; and then generates a variable-frequency first clock signal, and the second data signal and the first clock signal are transmitted to the source driving chip; simultaneously obtains the first clock signal and generates a second clock signal by frequency multiplication. The second clock signal is a preset multiple of the first clock signal. The second clock signal serves as an internal clock signal of a power supply chip circuit, and the second clock signal is inputted to the power supply chip circuit. The internal clock signal of the power supply chip circuit is no longer generated internally by itself, but an external input, and is a variable-frequency clock signal, thus reducing the electromagnetic interference and radiation of the power supply circuit. The present invention can be achieved easily and has a low cost. The internal circuit architecture of the power supply chip may be simplified.

BRIEF DESCRIPTION OF THE DRAWINGS

In order to clearly illustrate the embodiments of the present invention or the technical solutions in the existing technology, the following drawings, which are used in the description, are briefly described. The accompanying drawings in the following description are merely illustrative embodiments of the present invention. For those skilled in the art, the drawings of other embodiments may be obtained according to the accompanying drawings under the premise of not paying creative work.

DESCRIPTION OF THE PREFERRED EMBODIMENTS

For the purpose of understanding this application, the present invention will be described more fully hereinafter in conjunction with the accompanying drawings. A preferred embodiment of the present invention is described in detail in the accompanying drawings. However, the present invention may be embodied in many different forms and is not limited to the embodiments described herein. Rather, the purpose of providing these embodiments is to make the understanding of the disclosure of the present invention more thorough.

Figure 1:
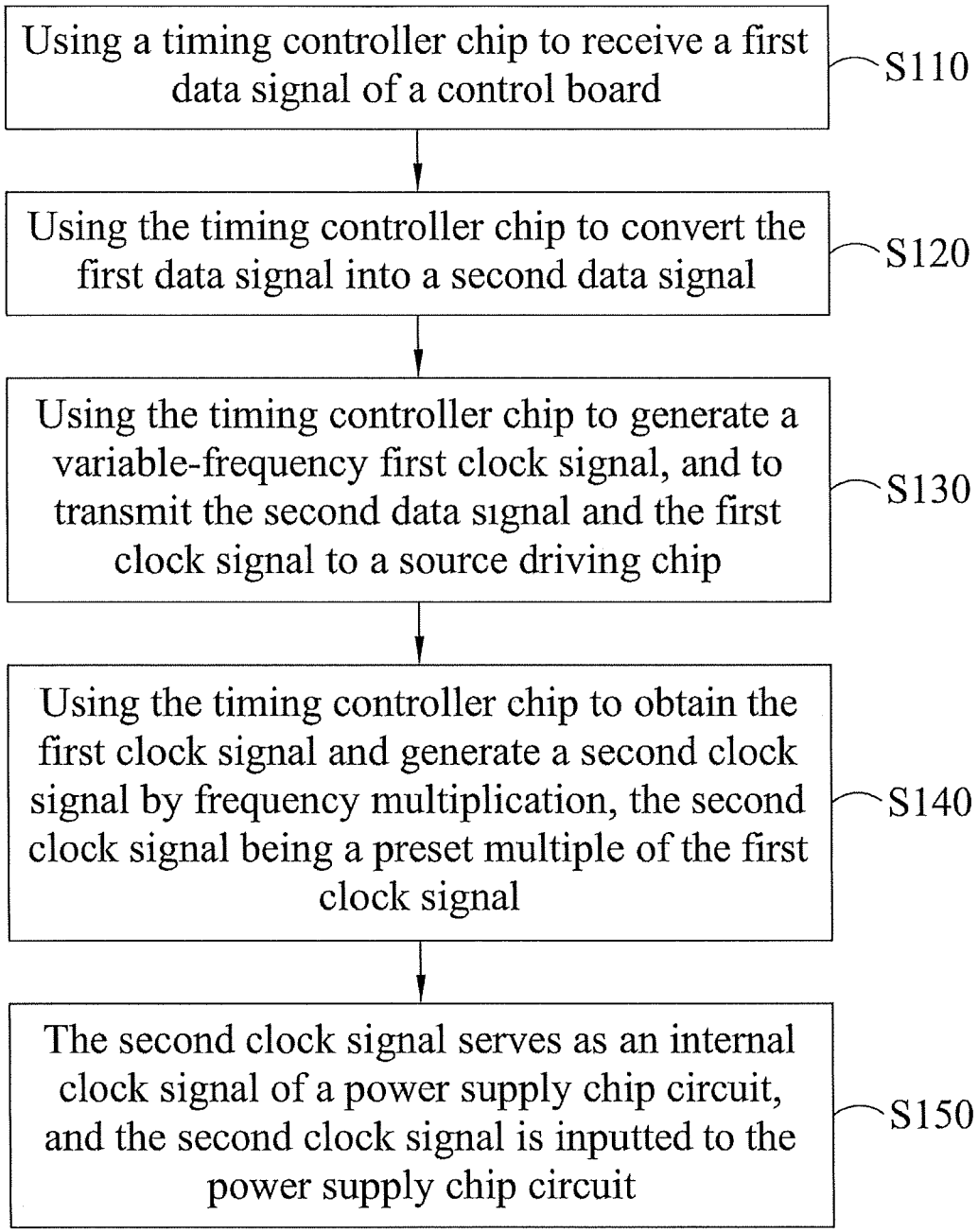
FIG. 1 is a flow chart of a driving method of a display panel in accordance with an embodiment of the present invention.

FIG. 1 is a flow chart of a driving method of a display panel. The method comprises the steps S110 to S150:

Step S110: using a timing controller chip to receive a first data signal of a control board;

Step S120: using the timing controller chip to convert the first data signal into a second data signal;

Step S130: using the timing controller chip to generate a variable-frequency first clock signal, and to transmit the second data signal and the first clock signal to a source driving chip;

Step S140: using the timing controller chip to obtain the first clock signal and generate a second clock signal by frequency multiplication, the second clock signal being a preset multiple of the first clock signal;

Step S150: the second clock signal serving as an internal clock signal of a power supply chip circuit, the second clock signal being inputted to the power supply chip circuit.

The timing controller chip (TCON) receives a first data signal transmitted by a front end system control board, and converts the first data signal into a second data signal of a driving data line; and then generates a variable-frequency first clock signal and transmits the second data signal and the first clock signal to the source driving chip; simultaneously obtains the first clock signal and generates a second clock signal by frequency multiplication. The second clock signal is a preset multiple of the first clock signal. The second clock signal serves as an internal clock signal of a power supply chip circuit, and the second clock signal is inputted to the power supply chip circuit. The internal clock signal of the power supply chip circuit is no longer generated internally by itself, but an external input, and is a variable-frequency clock signal, thus reducing the electromagnetic interference and radiation of the power supply circuit. The method can be achieved easily and has a low cost. The internal circuit architecture of the power supply chip may be simplified.

Figure 2:
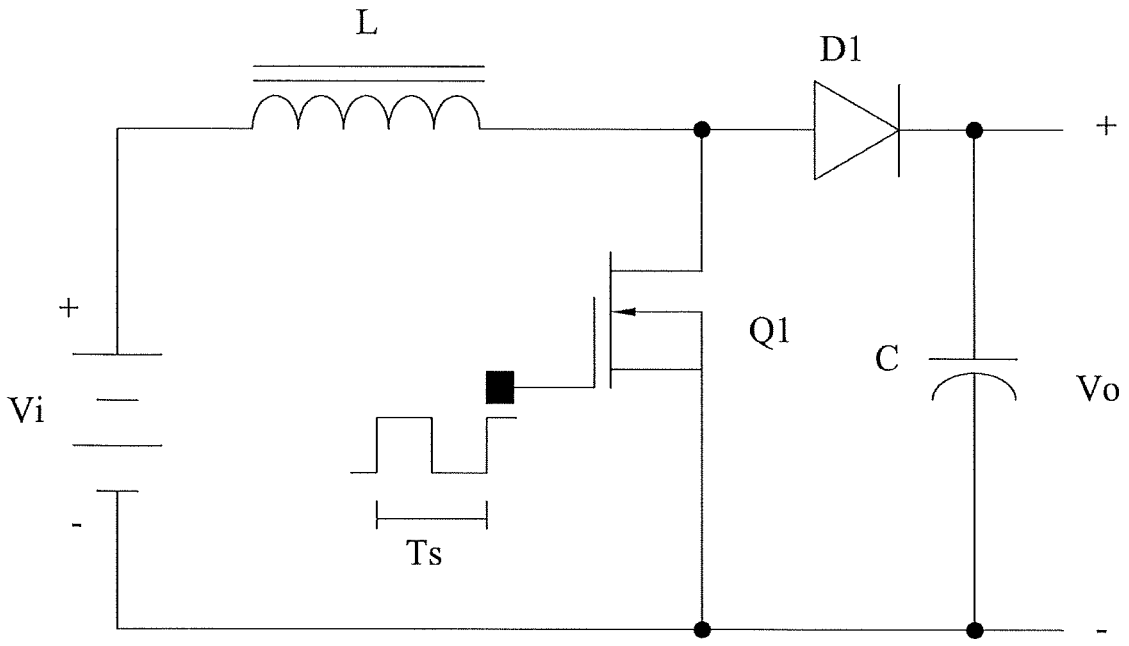
FIG. 2 is a control architecture of a power supply chip circuit in accordance with an embodiment of the present invention.
Figure 3:
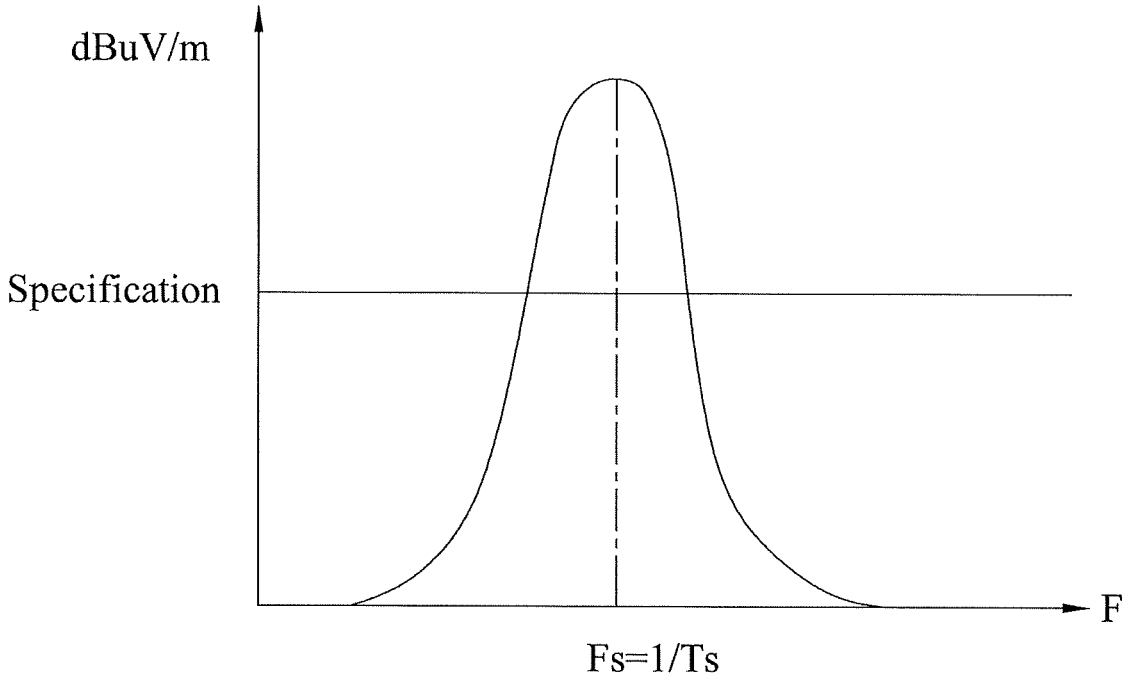
FIG. 3 is a schematic diagram of the electromagnetic radiation of a power supply chip circuit in accordance with an embodiment of the present invention.

FIG. 2 is a control architecture of the power supply chip circuit of this embodiment. The power supply Vi is an input power source. The field effect transistor Q1 is a switching tube inside the power supply chip circuit. The inductance L is an external inductance. The diode D1 is an external diode. The capacitor C is a voltage-stabilizing capacitor of a load end. The operating principle of the power supply chip circuit is that the internal switching tube Q1 is opened and closed constantly, and the input power Vi continues to charge and discharge the external inductance L to achieve the purpose of regulating the voltage. If the switching signal of the switching tube Q1 is a driving signal with a fixed period Ts, it will cause the radiation interference of the power supply to be concentrated in the frequency band of 1/Ts=Fs, resulting in excessive amplitude of radiation, as shown in FIG. 3. The switching signal of the switching tube Q1 of this embodiment uses the variable-frequency second clock signal to disperse the radiant energy of the power supply to different frequency bands, which can avoid excessive concentration of energy to result in excessive radiation at a certain frequency.

Wherein, the step S140 includes using a phase-locked loop module of the timing controller chip to obtain the first clock signal and generate a second clock signal by frequency multiplication. It is more accurate and stable to obtain the first clock signal through the phase-locked loop module.

Furthermore, the step S140 includes: dividing the second clock signal by the preset multiple by frequency demultiplication to generate a comparison clock signal; obtaining the first clock signal and comparing the first clock signal with the comparison clock signal to obtain a frequency difference value; generating an adjustment voltage according to the frequency difference value; and generating the second clock signal that is the preset multiple of the first clock signal according to the adjustment voltage. The second clock signal that is the preset multiple of the first clock signal can be obtained by the above steps. The comparison clock signal is generated by dividing the second clock signal by the preset multiple. The comparison clock signal is compared with the first clock signal to obtain the frequency difference value in real time to obtain the second clock signal which is more accurate. The preset multiple is determined by the relationship between the second clock signal required inside the power supply chip circuit and the first clock signal generated by the timing controller chip.

In an embodiment, the main difference between the present embodiment and the aforesaid embodiment is that the step S130 of using the timing controller chip to generate the variable-frequency first clock signal includes: using the timing controller chip to obtain a first frequency of the first clock signal, wherein the first frequency may be a standard frequency or the first frequency can be set according to the need; setting the maximum change frequency greater than the first frequency as a second frequency according to the first frequency, setting the minimum change frequency less than the first frequency as a third frequency according to the first frequency; and controlling the frequency of the first clock signal to change between the second frequency and the third frequency.

Furthermore, the frequency of the first clock signal is controlled to change cyclically between the second frequency, the first frequency, and the third frequency.

Specifically, the frequency change period T1 is set; the maximum change frequency f2 greater than the standard frequency and the minimum change frequency f0 less than the standard frequency are set according to the standard frequency f1; in the frequency change period T1, the frequency of the first clock signal changes between the minimum change frequency f0, the standard frequency f1, and the maximum change frequency f2.

Figure 4:
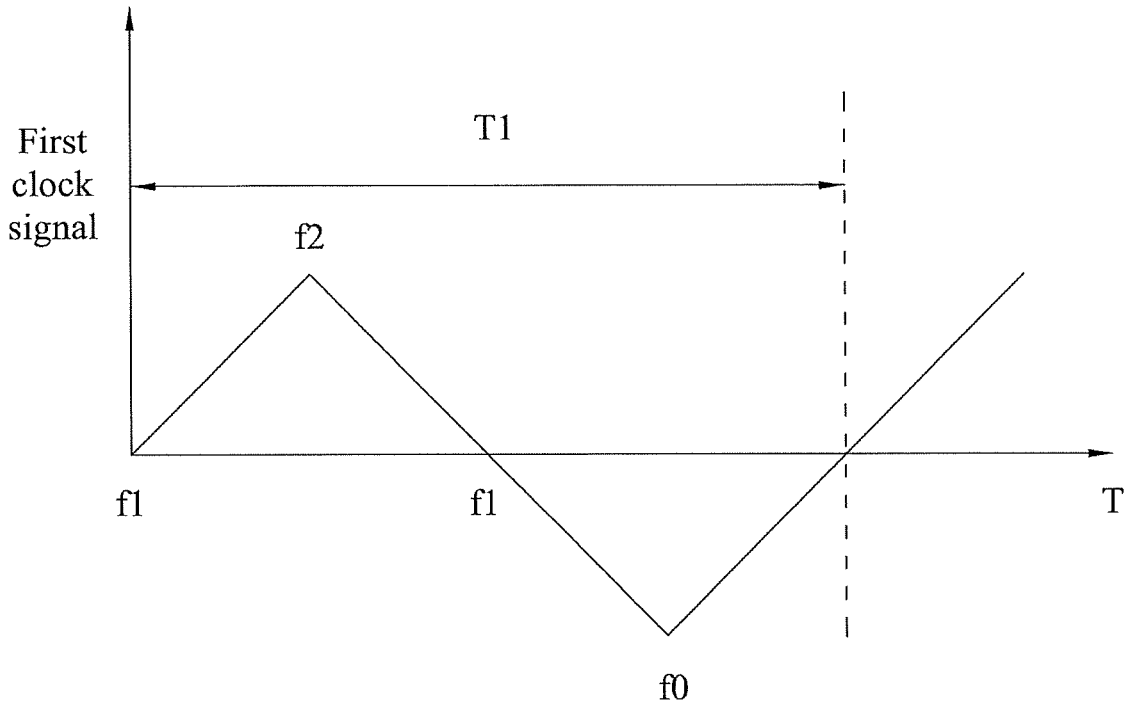
FIG. 4 is a schematic diagram of a first clock signal in accordance with an embodiment of the present invention.
Figure 5:
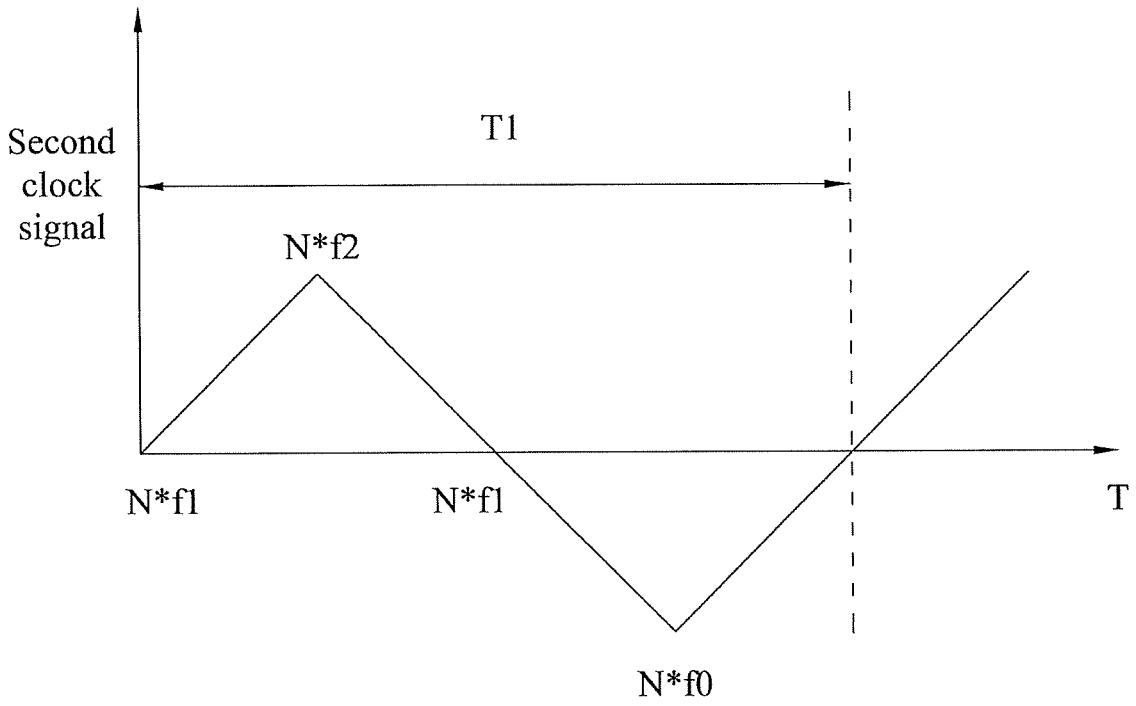
FIG. 5 is a schematic diagram of a second clock signal in accordance with an embodiment of the present invention.
Figure 6:
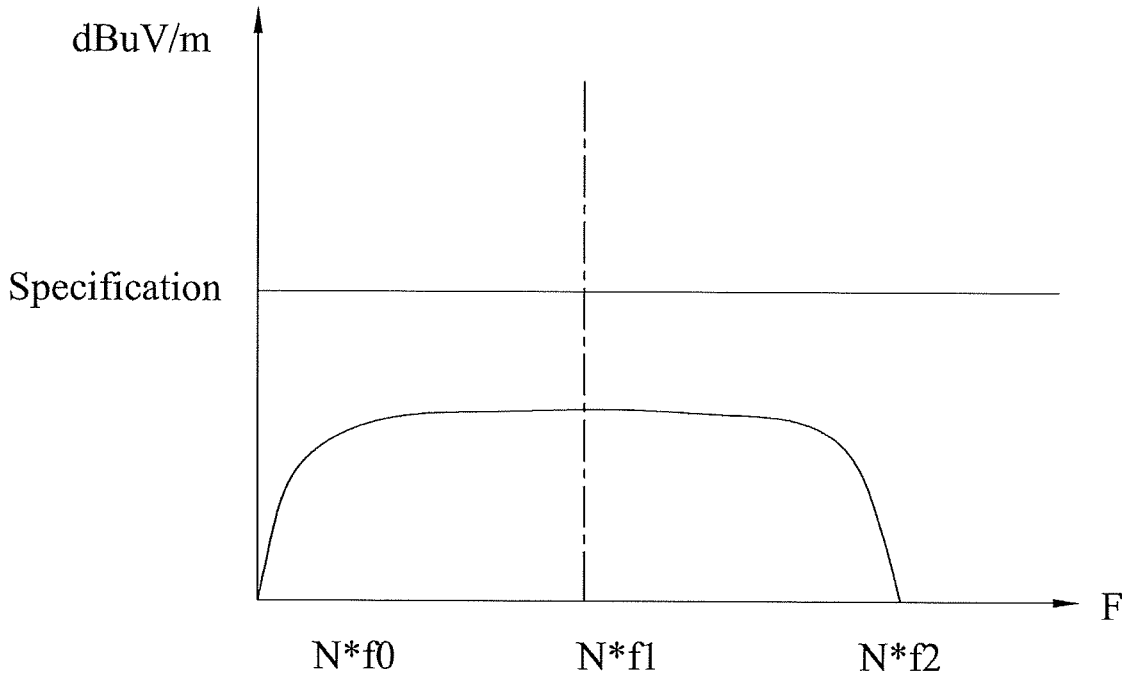
FIG. 6 is a schematic diagram of the electromagnetic radiation of a second clock signal in accordance with an embodiment of the present invention.

Thus, the variable-frequency change second clock signal can be obtained by multiplying the first clock signal. Specifically, in order to weaken the electromagnetic interference effect of the transmitted signal, the frequency f of the first clock signal outputted from the timing controller chip is set to be fixed, that is, the change period and the change amplitude are set in the vicinity of the standard frequency. For example, the standard frequency is f1, the minimum frequency is f0, the maximum frequency is f2, and the change period is set as T1. In the change period T1, the frequency of the first clock signal is changed cyclically between f0, f1, and f2, as shown in FIG. 4. Then, the frequency of the second clock signal is changed cyclically from N*f0, N*f1, N*f2. Wherein, N is the preset multiple. The frequency of the first clock signal is changed cyclically from f0 to f1, f1 to f2, f2 to f1, f1 to f1, or may be changed cyclically from and f1 to f2, f2 to f1, f1 to f0, f1 to f1, and so on. FIG. 5 illustrates the change of the second clock signal. FIG. 6 is a schematic view of the decrease in radiant energy. Thus, the radiation energy of the power supply can be dispersed to different frequency bands, which can avoid excessive concentration of energy to result in excessive radiation at a certain frequency.

As the timing controller chip for receiving and processing signals has the phase-locked loop module itself, a simple frequency multiplier circuit is added to achieve the aforesaid functions. This won't increase much cost, and the switching frequency generation circuit of the power supply chip circuit may be saved. A phase-locked loop module with a multiplier circuit may be provided.

The second clock signal of the switching frequency of the corresponding power supply chip circuit is generated by using the variable-frequency first clock signal of the timing controller chip of the system output end. By dispensing the switching frequency, the radiation interference can be reduced.

Figure 7:
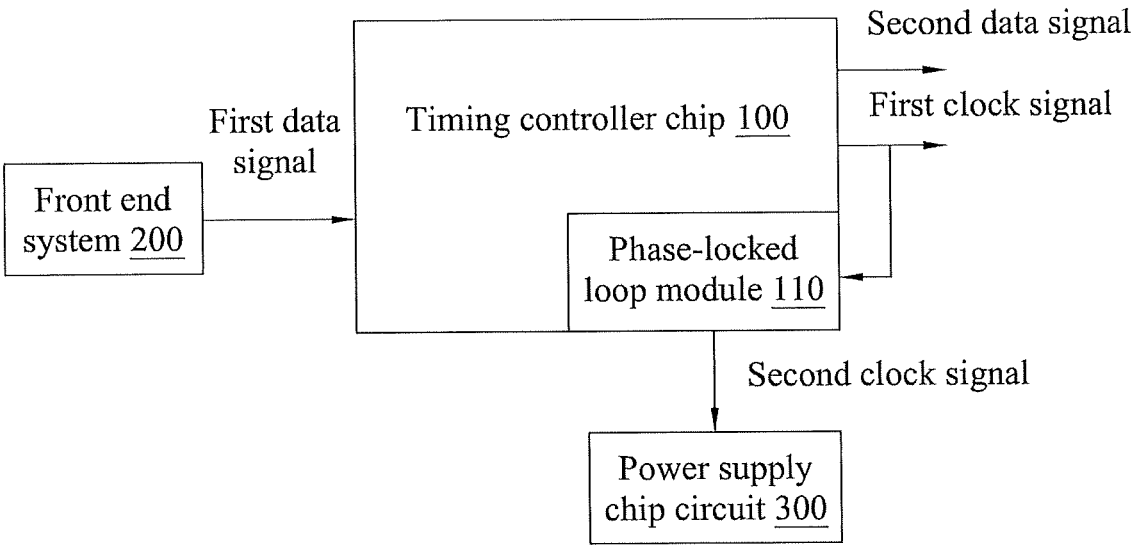
FIG. 7 is a block diagram of a driving device in accordance with an embodiment of the present invention.

FIG. 7 is a block diagram of a driving device. The driving device comprises a timing controller chip 100 and a power supply chip circuit 300.

Wherein, the timing controller chip 100 is configured to receive a first data signal of a control board and convert the first data signal into a second data signal of a driving data line. The timing controller chip 100 is further configured to generate a variable-frequency first clock signal and, to transmit the second data signal and the first clock signal to a source driving chip. The timing controller chip is further configured to obtain the first clock signal and generate a second clock signal by frequency multiplication. The second clock signal is a preset multiple of the first clock signal.

The power supply chip circuit 300 is configured to receive the second clock signal and driving an internal circuit of the power supply chip circuit in accordance with the second clock signal.

The timing controller chip (TCON) receives a first data signal transmitted by a front end system control board and converts the first data signal into a second data signal of a driving data line; and then generates a variable-frequency first clock signal and transmits the second data signal and the first clock signal to the source driving chip. The phase-locked loop module simultaneously obtains the first clock signal and generates a second clock signal by frequency multiplication. The second clock signal is a preset multiple of the first clock signal. The power supply chip circuit is configured to receive the second clock signal and driving an internal circuit of the power supply chip circuit in accordance with the second clock signal. The internal clock signal of the power supply chip circuit is no longer generated internally by itself, but an external input, and is a variable-frequency clock signal, thus reducing the electromagnetic interference and radiation of the power supply circuit. The driving device can be achieved easily and has a low cost. The internal circuit architecture of the power supply chip may be simplified.

FIG. 2 is a control architecture of the power supply chip circuit of this embodiment. The power supply Vi is an input power source. The field effect transistor Q1 is a switching tube inside the power supply chip circuit. The inductance L is an external inductance. The diode D1 is an external diode. The capacitor C is a voltage-stabilizing capacitor of a load end. The operating principle of the power supply chip circuit is that the internal switching tube Q1 is opened and closed constantly, and the input power Vi continues to charge and discharge the external inductance L to achieve the purpose of regulating the voltage. If the switching signal of the switching tube Q1 is a driving signal with a fixed period Ts, it will cause the radiation interference of the power supply to be concentrated in the frequency band of 1/Ts=Fs, resulting in excessive amplitude of radiation. The switching signal of the switching tube Q1 of this embodiment uses the variable-frequency second clock signal to disperse the radiant energy of the power supply to different frequency bands, which can avoid excessive concentration of energy to result in excessive radiation at a certain frequency.

As shown in FIG. 7, the timing controller chip 100 includes a phase-locked loop module 100 to obtain the first clock signal and generate a second clock signal by frequency multiplication. The second clock signal is a preset multiple of the first clock signal. The second clock signal is transmitted to the power supply chip circuit as an internal clock signal of the power supply chip circuit. It is more accurate and stable to obtain the first clock signal through the phase-locked loop module. The timing controller chip 100 receives a first data signal (such as, showing data) of a front end system 200 (such as, a control board). The first data signal is processed to become a second data signal of a driving data line. The second data signal and the variable-frequency first clock signal are transmitted to the source driving chip of the rear end.

Figure 8:
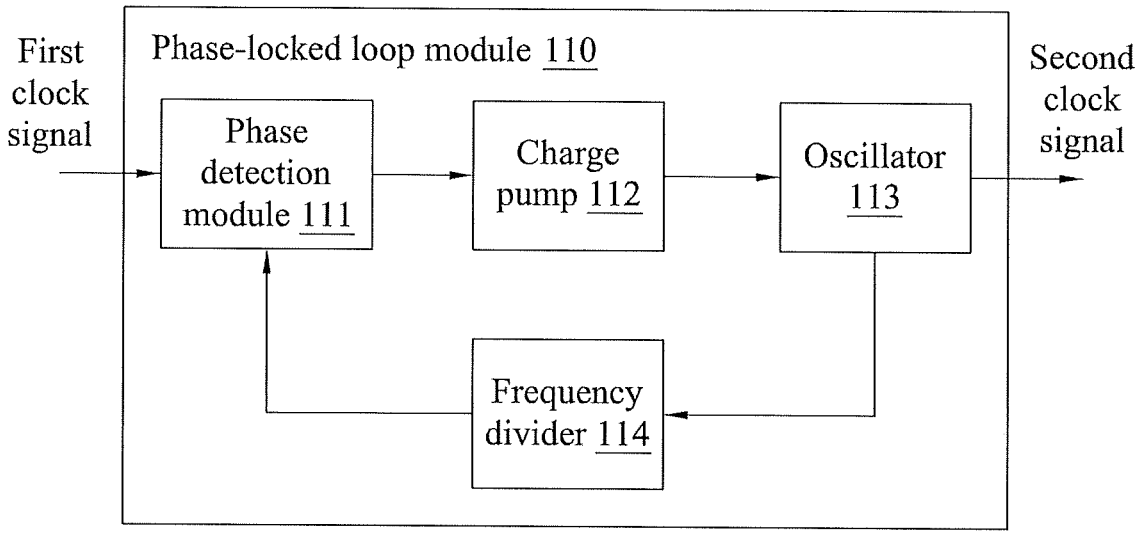
FIG. 8 is a block diagram of a driving device in accordance with another embodiment of the present invention.

Furthermore, as shown in FIG. 8, the phase-locked loop module 110 includes a phase detection module 111, a charge pump 112, an oscillator 113, and a frequency divider 114.

The frequency divider 114 is configured to dividing the second clock signal by the preset multiple to generate a comparison clock signal.

The phase detection module 111 is configured to collecting the first clock signal by phase locking and comparing the first clock signal with the comparison clock signal to obtain a frequency difference value.

The charge pump 112 is configured to generate an adjustment voltage according to the frequency difference value.

The oscillator 113 is configured to generate the second clock signal that is the preset multiple of the first clock signal according to the adjustment voltage.

The oscillator 113 may obtain that second clock signal that is the preset multiple of the first clock signal preset. Through the frequency divider, the second clock signal Fs is divided by the preset multiple N to generate the comparison clock signal Fs/N, and then the phase detection module 111 compares the clock signal Fs/N with the first clock signal f to obtain the frequency difference value ΔF. The charge pump 113 obtains an adjustment voltage ΔV in real time according to the frequency difference value ΔF to obtain a more accurate second clock signal. The preset multiple is determined by the relationship between the second clock signal required inside the power supply chip circuit and the first clock signal generated by the timing controller chip.

In an embodiment, the timing controller chip of the present embodiment further comprises a frequency change device for obtaining a first frequency of the first clock signal; and setting the maximum change frequency greater than the first frequency as a second frequency according to the first frequency and setting the minimum change frequency less than the first frequency as a third frequency according to the first frequency. Wherein, the frequency change device is further configured to controlling the frequency of the first clock signal to change between the second frequency and the third frequency.

The frequency change device may be disposed outside the phase-locked loop. Thus, the variable-frequency second clock signal can be obtained by multiplying the first clock signal. Specifically, in order to weaken the electromagnetic interference effect of the transmitted signal, the frequency f of the first clock signal outputted from the timing controller chip is set to be fixed, that is, the change period and the change amplitude are set in the vicinity of the standard frequency. For example, the standard frequency is f1, the minimum frequency is f0, the maximum frequency is f2, and the change period is set as T1. In the change period T1, the frequency of the first clock signal is changed cyclically between f0, f1, and f2, as shown in FIG. 4. Then, the frequency of the second clock signal is changed cyclically from N*f0, N*f1, N*f2. Wherein, N is the preset multiple. The frequency of the first clock signal is changed cyclically from f0 to f1, f1 to f2, f2 to f1, f1 to f1), or may be changed cyclically from and f1 to f2, f2 to f1, f1 to f0, f0 to f1, and so on. FIG. 5 illustrates the change of the second clock signal. FIG. 6 is a schematic view of the decrease in radiant energy. Thus, the radiation energy of the power supply can be dispersed to different frequency bands, which can avoid excessive concentration of energy to result in excessive radiation at a certain frequency.

As the timing controller chip for receiving and processing signal has the phase-locked loop module itself, a simple frequency multiplier circuit is added to achieve the aforesaid functions. This won't increase much cost, and the switching frequency generation circuit of the power supply chip circuit may be saved. A phase-locked loop module with a multiplier circuit may be provided.

The second clock signal of the switching frequency of the corresponding power supply chip circuit is generated by using the variable-frequency first clock signal of the timing controller chip of the system output end. By dispensing the switching frequency, the radiation interference can be reduced.

A display device comprises a display panel and any one of the aforesaid driving devices. The driving device can improve the problem of the electromagnetic interference of the power supply chip circuit of the display panel. The display panel may be TN (Twisted Nematic), OCB (Optically Compensated Birefringence) or VA (Vertical Alignment) type liquid crystal display panel, and it may be a OLED (Organic Light Emitting Diode) Light emitting diodes) or QLED (Quantum dots Light-emitting Diodes) type display panel, but are not limited thereto. The display panel may be an RGB primary color panel, an RGBW four-color panel, or an RGBY four-color panel, but is not limited thereto. The driving method is also applicable when the display panel is a curved panel.

Figure 9:
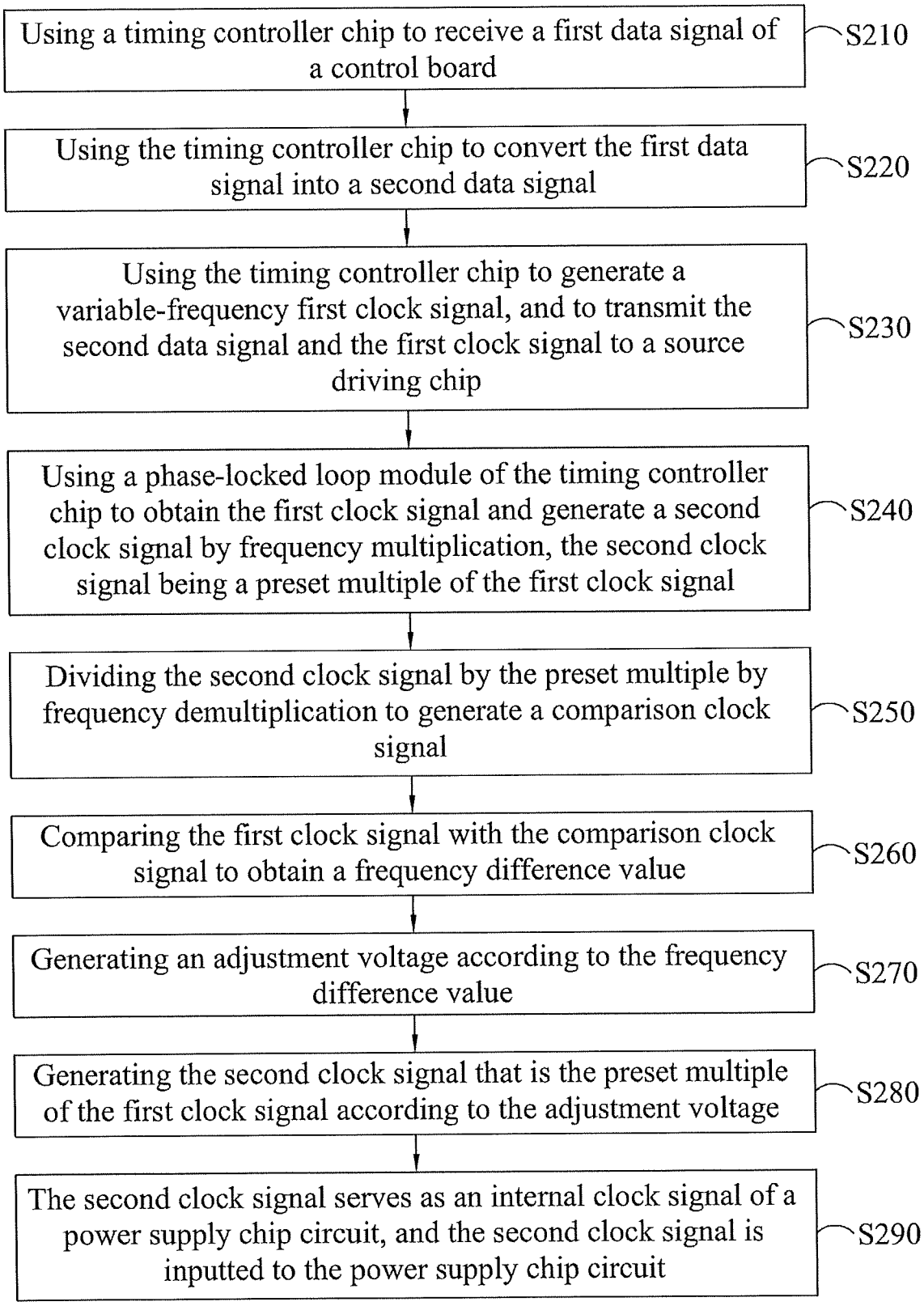
FIG. 9 is a flow chart of a driving method of a display panel in accordance with another embodiment of the present invention.

FIG. 9 is a flow chart of a driving method of a display panel in accordance with another embodiment. The method comprises the following steps:

Step S210: using a timing controller chip to receive a first data signal of a control board;

Step S220: using the timing controller chip to convert the first data signal into a second data signal;

Step S230: using the timing controller chip to generate a variable-frequency first clock signal, and to transmit the second data signal and the first clock signal to a source driving chip;

Step S240: using a phase-locked loop module of the timing controller chip to obtain the first clock signal and generate a second clock signal by frequency multiplication, the frequency of the second clock signal being a preset multiple of the frequency of the first clock signal;

Step S250: dividing the second clock signal by the preset multiple by frequency demultiplication to generate a comparison clock signal;

Step S260: comparing the first clock signal with the comparison clock signal to obtain a frequency difference value;

Step S270: generating an adjustment voltage according to the frequency difference value;

Step S280: generating the second clock signal that is the preset multiple of the first clock signal according to the adjustment voltage; and Step S290: the second clock signal serving as an internal clock signal of a power supply chip circuit, the second clock signal being inputted to the power supply chip circuit.

The technical features of the embodiments described above can be arbitrarily combined. In order to make the description precise, not all of the possible combinations of the respective technical features of the aforesaid embodiments are described. However, as long as there is no contradiction in the combination of these technical features, it should be considered as the scope of this description.

The embodiments described above are merely illustrative of several embodiments of the present invention and are more specific and detailed, but are not to be construed as limiting the scope of the present invention. It should be noted that it will be apparent to those skilled in the art that various modifications and improvements can be made therein without departing from the spirit of the present invention, and all of which are within the scope of the present application. Accordingly, the present invention is not to be limited except as by the appended claims.

What is claimed is:

1. A driving method of a display panel, comprising the steps of:

using a timing controller chip to receive a first data signal of a control board;

using the timing controller chip to convert the first data signal into a second data signal;

using the timing controller chip to generate a variable-frequency first clock signal, and to transmit the second data signal and the first clock signal to a source driving chip; and using the timing controller chip to obtain the first clock signal and generate a second clock signal by frequency multiplication, a frequency of the second clock signal being a preset multiple of a frequency of the first clock signal;

wherein the second clock signal serves as an internal clock signal of a power supply chip circuit, and the second clock signal is inputted to the power supply chip circuit.

2. The method as claimed in claim 1, wherein the step of using the timing controller chip to obtain the first clock signal and generate the second clock signal by frequency multiplication comprises:

using a phase-locked loop module of the timing controller chip to obtain the first clock signal and generate the second clock signal by frequency multiplication.

3. The method as claimed in claim 1, wherein the step of using the timing controller chip to obtain the first clock signal and generate the second clock signal by frequency multiplication comprises:

dividing the second clock signal by the preset multiple by frequency demultiplication to generate a comparison clock signal;

obtaining the first clock signal and comparing the first clock signal with the comparison clock signal to obtain a frequency difference value;

generating an adjustment voltage according to the frequency difference value; and generating the second clock signal that is the preset multiple of the first clock signal according to the adjustment voltage.

4. The method as claimed in claim 1, wherein the step of using the timing controller chip to generate the variable-frequency first clock signal comprises:

using the timing controller chip to obtain a first frequency of the first clock signal;

setting a maximum change frequency greater than the first frequency as a second frequency according to the first frequency, setting a minimum change frequency less than the first frequency as a third frequency according to the first frequency; and controlling the frequency of the first clock signal to change between the second frequency and the third frequency.

5. The method as claimed in claim 4, wherein the step of controlling the frequency of the first clock signal to change between the second frequency and the third frequency comprises:

controlling the frequency of the first clock signal to change cyclically between the second frequency, the first frequency, and the third frequency.

6. The method as claimed in claim 5, wherein the step of controlling the frequency of the first clock signal to change cyclically between the second frequency, the first frequency, and the third frequency comprises:

controlling the frequency of the first clock signal to change cyclically from the third frequency to the first frequency, from the first frequency to the second frequency, from the second frequency to the first frequency, and from the first frequency to the third frequency.

7. The method as claimed in claim 5, wherein the step of controlling the frequency of the first clock signal to change cyclically between the second frequency, the first frequency, and the third frequency comprises:

controlling the frequency of the first clock signal to change cyclically from the first frequency to the second frequency, from the second frequency to the first frequency, from the first frequency to the third frequency, and from the third frequency to the first frequency.

8. A driving device, comprising:

a timing controller chip, configured to receive a first data signal of a control board and convert the first data signal into a second data signal of a driving data line; further configured to generate a variable-frequency first clock signal, and to transmit the second data signal and the first clock signal to a source driving chip; further configured to obtain the first clock signal and generate a second clock signal by frequency multiplication, the second clock signal being a preset multiple of the first clock signal; and a power supply chip circuit, configured to receive the second clock signal and driving an internal circuit of the power supply chip circuit according to the second clock signal.

9. The driving device as claimed in claim 8, wherein the timing controller chip includes a phase-locked loop module, the phase-locked loop module is configured to obtain the first clock signal and generate a second clock signal by frequency multiplication.

10. The driving device as claimed in claim 9, wherein the phase-locked loop module comprises:

a frequency divider, configured to divide the second clock signal by the preset multiple to generate a comparison clock signal;

a phase detection module, configured to obtain the first clock signal and compare the first clock signal with the comparison clock signal to obtain a frequency difference value;

a charge pump, configured to generate an adjustment voltage according to the frequency difference value; and an oscillator, configured to generate the second clock signal that is the preset multiple of the first clock signal according to the adjustment voltage.

11. The driving device as claimed in claim 8, wherein the timing controller chip further comprises a frequency change device, wherein the frequency change device is configured to obtain a first frequency of the first clock signal, set a maximum change frequency greater than the first frequency as a second frequency according to the first frequency and set a minimum change frequency less than the first frequency as a third frequency according to the first frequency; and controls a frequency of the first clock signal to change between the second frequency and the third frequency.

12. The driving device as claimed in claim 11, wherein the frequency change device is further configured to control the frequency of the first clock signal to change cyclically from the third frequency to the first frequency, from the first frequency to the second frequency, from the second frequency to the first frequency, and from the first frequency to the third frequency.

13. The driving device as claimed in claim 11, wherein the frequency change device is further configured to control the frequency of the first clock signal to change cyclically from the first frequency to the second frequency, from the second frequency to the first frequency, from the first frequency to the third frequency, and from the third frequency to the first frequency.

14. A driving method of a display panel, comprising the steps of:

using a timing controller chip to receive a first data signal of a control board;

using the timing controller chip to convert the first data signal into a second data signal;

using the timing controller chip to generate a variable-frequency first clock signal, and to transmit the second data signal and the first clock signal to a source driving chip;

using a phase-locked loop module of the timing controller chip to obtain the first clock signal and generate a second clock signal by frequency multiplication, a frequency of the second clock signal being a preset multiple of a frequency of the first clock signal;

dividing the second clock signal by the preset multiple by frequency demultiplication to generate a comparison clock signal;

comparing the first clock signal with the comparison clock signal to obtain a frequency difference value;

generating an adjustment voltage according to the frequency difference value; and generating the second clock signal that is the preset multiple of the first clock signal according to the adjustment voltage;

wherein the second clock signal serves as an internal clock signal of a power supply chip circuit, and the second clock signal is inputted to the power supply chip circuit.

* * * * *